US007351372B2

(12) United States Patent
Inohana et al.

(10) Patent No.: US 7,351,372 B2
(45) Date of Patent: Apr. 1, 2008

(54) COPPER BASE ALLOY AND METHOD FOR PRODUCING SAME

(75) Inventors: Yasuo Inohana, Shizuoka (JP); Akira Sugawara, Chiba (JP); Toshihiro Sato, Shizuoka (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

(21) Appl. No.: 10/667,709

(22) Filed: Sep. 22, 2003

(65) Prior Publication Data

US 2004/0140022 A1 Jul. 22, 2004

(30) Foreign Application Priority Data

Jan. 22, 2003 (JP) ..... P2003-013038

(51) Int. Cl.
*C22C 9/00* (2006.01)

(52) U.S. Cl. ..... 420/476; 148/433

(58) Field of Classification Search ..... 420/470–484; 148/433–434

See application file for complete search history.

(56) References Cited

U.S. PATENT DOCUMENTS

| | | | | |
|---|---|---|---|---|
| 3,403,997 | A | 10/1968 | Badia | |
| 4,075,392 | A | 2/1978 | Jaeger | |
| 4,373,970 | A | 2/1983 | Scorey et al. | |
| 4,732,625 | A | 3/1988 | Livak | |
| 4,749,548 | A | 6/1988 | Akutsu et al. | |
| 6,471,792 | B1 * | 10/2002 | Breedis et al. | 148/433 |

FOREIGN PATENT DOCUMENTS

| | | | |
|---|---|---|---|
| EP | 0 411 882 | | 2/1991 |
| EP | 0 872 564 | | 10/1998 |
| EP | 0 995 808 | | 4/2000 |
| GB | 1122490 | | 8/1968 |
| GB | 2 066 849 | | 7/1981 |
| JP | 60036638 | * | 2/1985 |
| JP | 61-130478 | | 6/1986 |
| JP | 63-35761 | | 2/1988 |
| JP | 04013825 | | 1/1992 |
| JP | 04013825 | * | 10/1992 |
| JP | 11323463 | | 11/1999 |
| JP | 2000-149970 | A | 5/2000 |
| JP | 2001-294957 | | 10/2001 |
| JP | 2001-303159 | | 10/2001 |
| JP | 2002-275563 | | 9/2002 |
| JP | 2002285263 | * | 10/2002 |
| WO | WO 00/29632 | | 5/2000 |

OTHER PUBLICATIONS

Hansen Max., Constitution of Binary Alloys, McGraw-Hill Book Company, Inc. 1958, pp. 649-653.*

* cited by examiner

*Primary Examiner*—Sikyin Ip
(74) *Attorney, Agent, or Firm*—Bachman & LaPointe, P.C.

(57) ABSTRACT

As a raw material of a copper base alloy containing at least one of 0.2 to 12 wt % of tin and 8 to 45 wt % of zinc, at least one of a copper base alloy having a large surface area and containing carbon on the surface thereof, a copper base alloy having a liquidus line temperature of 1050° C. or less, a copper base alloy surface-treated with tin, and a copper base alloy containing 20 to 1000 ppm of carbon, is used for obtaining a copper base alloy having an excellent hot workability. If necessary, when the raw material of the copper base alloy is melted, the material of the copper base alloy may be coated with a solid material containing 70 wt % or more of carbon, or 0.005 to 0.5 wt % of a solid deoxidizer having a stronger affinity with O than C with respect to the weight of the molten metal may be added to the molten metal.

6 Claims, No Drawings

COPPER BASE ALLOY AND METHOD FOR PRODUCING SAME

BACKGROUND OF THE INVENTION

1. Field of the Invention

The present invention generally relates to a copper base alloy and a method for producing the same. More specifically, the invention relates to a copper base alloy having an excellent hot workability, which is used as the material of electric and electronic parts, such as connectors, and a method for producing the same.

2. Description of the Prior Art

In recent years, with the development of electronics, the complication and integration of electric wiring for various machines is advanced to increase the amount of wrought copper and copper-alloys used as the materials of electric and electronic parts, such as connectors. In addition, it is required to decrease the weight and production costs of electric and electronic parts, such as connectors, and it is required to enhance the reliability thereof. In order to meet these requirements, copper alloy materials for connectors are thinned and pressed in complicated shapes, so that the strength, elasticity, conductivity, bending workability and press moldability thereof must be good.

Phosphor bronzes containing tin (Sn) and phosphorus (P) in copper (Cu) have excellent characteristics, such as excellent spring characteristic, workability and press punching quality, and are utilized as the materials of many electric and electronic parts, such as connectors. However, it is required to decrease production costs of phosphor bronzes, and it is required to improve conductivity thereof. In addition, phosphor bronzes have a bad hot workability to be easily broken if hot-worked, so that a plate of a phosphor bronze is usually produced by repeating homogenization, cold rolling and annealing of an ingot having a thickness of about 10 to 30 mm, which is obtained by the horizontal continuous casting. Therefore, the improvement of the hot workability of phosphor bronzes can greatly contribute to a decrease in production costs of phosphor bronzes. As methods for improving the hot workability of phosphorbronzes, there have been proposed methods for improving the hot workability of phosphor bronzes by setting predetermined temperature and working conditions during hot working (see, e.g. Japanese Patent Laid-Open Nos. 63-35761 and 61-130478), and methods for improving the hot workability of phosphor bronzes by adding iron (Fe), nickel (Ni), cobalt (Co) and manganese (Mn) for improving the hot workability and by controlling the amount of elements for inhibiting the hot workability so that it is a very small amount (see, e.g. Japanese Patent Laid-Open No. 2002-275563).

In addition, brasses containing zinc (Zn) in copper (Cu) have excellent characteristics, such as excellent workability and press punching quality and low costs, and are utilized as the materials of many electric parts, such as connectors. However, it is required to further improve the strength, spring characteristic, stress relaxation resistance and stress corrosion cracking resistance of brasses in order to cope with the miniaturization of parts and the deterioration of working environments. In such circumstances, there have been proposed methods for improving the above described characteristics by adding a predetermined amount of tin (Sn) to a Cu—Zn alloy (see, e.g. Japanese Patent Laid-Open Nos. 2001-294957 and 2001-303159).

However, in the above described methods disclosed in Japanese Patent Laid-Open Nos. 63-35761, 61-130478 and 2002-275563, there are many constraints on production conditions and component elements. Therefore, it is required to provide a method capable of decreasing such constraints.

In addition, the above described Cu—Zn—Sn alloys disclosed in Japanese Patent Laid-Open Nos. 2001-294957 and 2001-303159 are formed as a plate having a predetermined thickness usually by a method comprising the steps of carrying out the longitudinal continuous casting, heating the obtained ingot by a heating furnace, extending the heated ingot by hot rolling, and thereafter, repeating cold rolling and annealing. Although the mechanical characteristics, such as tensile strength and 0.2% proof stress, stress relaxation resistance and stress corrosion cracking resistance of Cu—Zn—Sn alloys can be improved by the addition of Sn, it is desired to improve the hot workability thereof. That is, there are some cases where Cu—Zn—Sn alloys may be broken during hot rolling to deteriorate the surface quality and yields of products, so that it is desired to improve the hot workability of Cu—Zn—Sn alloys.

One of the reasons why the hot workability is deteriorated by adding Sn to Cu or Cu—Zn alloys is that the temperature difference between the liquidus and solidus lines of copper base alloys. Thus, Sn and Zn segregate during casting, and phases having low melting points remain during solidification. For example, phases having low melting points, such as a Cu—Sn epsilon phase, a Cu—Zn gamma phase and a phase formed by solid-dissolving Cu and/or Zn in an Sn solid solution, remain in Cu—Zn—Sn alloys. Thus, the remaining second phase is dissolved during overheating when hot rolling is carried out, so that the hot workability deteriorates. Therefore, it is required to provide a copper base alloy having a more excellent hot workability. If Sn is added to a Cu—Zn alloy, the temperature difference between solidus and liquidus lines is easy to be greater than that when Sn is added to Cu, so that it is desired to improve the hot workability.

In addition, if Mn, Al, Si, Ni, Fe, Cr, Co, Ti, Bi, Pb, Mg, P, Ca, Y, Sr, Be and/or Zr is added to a Cu—Zn alloy or Cu—Sn alloy, it can be expected to improve characteristics, such as 0.2% proof stress, tensile strength, spring limit value, stress relaxation resistance, stress corrosion cracking resistance and dezincing resistance, due to the additional element(s). However, the above described temperature difference between liquidus and solidus lines (a melting/solidification range) increases to deteriorate the hot workability, so that it is required to provide a copper base alloy capable of being more simply cast in good yield.

As an example of a method for preventing the production of cracks in a copper base alloy during hot rolling, Japanese Patent Laid-Open No. 2001-294957 has proposed a methods for preventing the production of hot cracks in a Cu—Zn—Sn alloy by restricting composition, controlling the cooling rate during melting/casting, or controlling the maximum temperature during hot rolling. However, it is desired to provide a method for more simply improving the hot workability of the copper base alloy.

SUMMARY OF THE INVENTION

It is therefore an object of the present invention to eliminate the aforementioned problems and to provide a copper base alloy containing at least one of Zn and Sn and having an excellent hot workability, and a method capable of simply producing the copper alloy.

In order to accomplish the aforementioned and other objects, the inventors have diligently studied and found that it is possible to greatly improve the hot workability of a copper base alloy containing at least one of Zn and Sn by causing the copper base alloy to contain a small amount of carbon. In addition, the inventors have found a method for efficiently causing the copper base alloy to contain carbon although it is difficult to cause the copper alloy to easily contain carbon since the degree of solid solution of carbon in copper is usually small and since the difference in specific gravity between carbon and copper is great.

According to one aspect of the present invention, a copper base alloy comprises at least one of 8 to 45 wt % of zinc and 0.2 to 12.0 wt % of tin, 20 to 1000 ppm of carbon, and the balance being copper and unavoidable impurities.

The copper base alloy may further comprise one or more elements which are selected from the group consisting of 0.01 to 10.0 wt % of manganese, 0.01 to 10.0 wt % of aluminum, 0.01 to 3.0 wt % of silicon, 0.01 to 15.0 wt % of nickel, 0.01 to 5.0 wt % of iron, 0.01 to 5.0 wt % of chromium, 0.01 to 2.5 wt % of cobalt, 0.01 to 3.0 wt % of titanium, 0.001 to 4.0 wt % of bismuth, 0.05 to 4.0 wt % of lead, 0.01 to 2.0 wt % of magnesium, 0.01 to 0.5 wt % of phosphorus, 0.0005 to 0.5 wt % of boron, 0.01 to 0.1 wt % of calcium, 0.01 to 0.1 wt % of yttrium, 0.01 to 0.1 wt % of strontium, 0.01 to 1.0 wt % of beryllium, 0.01 to 0.5 wt % of zirconium, 0.1 to 3.0 wt % of niobium, 0.1 to 3.0 wt % of vanadium, 0.1 to 3.0 wt % of hafnium, 0.1 to 3.0 wt % of molybdenum and 0.1 to 3.0 wt % of tantalum, the total amount of the elements being 50 wt % or less. In the above described copper base alloy, a phase having a melting point of 800° C. or less, other than an alpha phase, preferably has a volume percentage of 20% or less. Moreover, the difference in temperature between liquidus and solidus lines is preferably 30° C. or more.

According to another aspect of the present invention, there is provided a method for producing a copper base alloy, the method comprising the steps of: heating and melting raw materials of a copper base alloy containing at least one of 8 to 45 wt % of zinc and 0.2 to 12.0 wt % of tin; causing the raw materials of the copper base alloy to contain 20 to 1000 ppm of carbon; and cooling the raw materials of the copper base alloy.

In this method for producing a copper base alloy, the raw materials of the copper base alloy preferably contain at least one of carbon absorbed on the surface thereof, a mother alloy containing carbon, 20% or more of a copper base alloy having a liquidus line temperature of 1050° C. or less with respect to the weight of a molten metal of the raw materials of the copper base alloy, and a material surface-treated with tin. In addition, the raw materials of the copper base alloy are preferably heated and melted in a vessel which is coated with a solid material containing 70 wt % or more of carbon. Moreover, a solid deoxidizer having a stronger affinity with oxygen than carbon is preferably added when the raw materials of the copper base alloy are melted. The solid deoxidizer is preferably selected from the group consisting of B, Ca, Y, P, Al, Si, Mg, Sr and Be, the amount of the solid deoxidizer being 0.005 to 0.5 wt % with respect to the weight of a molten metal of the raw materials of the copper base alloy.

In the above described method for producing a copper base alloy, the copper base alloy may further contain one or more elements which are selected from the group consisting of 0.01 to 10.0 wt % of manganese, 0.01 to 10.0 wt % of aluminum, 0.01 to 3.0 wt % of silicon, 0.01 to 15.0 wt % of nickel, 0.01 to 5.0 wt % of iron, 0.01 to 5.0 wt % of chromium, 0.01 to 2.5 wt % of cobalt, 0.01 to 3.0 wt % of titanium, 0.001 to 4.0 wt % of bismuth, 0.05 to 4.0 wt % of lead, 0.01 to 2.0 wt % of magnesium, 0.01 to 0.5 wt % of phosphorus, 0.0005 to 0.5 wt % of boron, 0.01 to 0.1 wt % of calcium, 0.01 to 0.1 wt % of yttrium, 0.01 to 0.1 wt % of strontium, 0.01 to 1.0 wt % of beryllium, 0.01 to 0.5 wt % of zirconium, 0.1 to 3.0 wt % of niobium, 0.1 to 3.0 wt % of vanadium, 0.1 to 3.0 wt % of hafnium, 0.1 to 3.0 wt % of molybdenum and 0.1 to 3.0 wt % of tantalum, the total amount of the elements being 50 wt % or less. A phase of the copper base alloy having a melting point of 800° C. or less, other than an alpha phase, preferably has a volume percentage of 20% or less. Moreover, the difference in temperature between liquidus and solidus lines of the copper base alloy is preferably 30° C. or more.

DESCRIPTION OF THE PREFERRED EMBODIMENTS

In a preferred embodiment of the present invention, a copper base alloy contains at least one of 8 to 45 wt % of zinc (Zn) and 0.2 to 12 wt % of tin (Sn), 20 to 1000 ppm of carbon (C), and the balance being copper and unavoidable impurities. The reasons why the amounts of the components of the copper base alloy are thus restricted are as follows.

In the preferred embodiment of the present invention, 20 to 1000 ppm of C is the essential element contained in the copper base alloy. If an ingot of a copper base alloy, such as a Cu—Zn or Cu—Sn alloy, which has a large temperature difference between liquidus and solidus lines, is hot-rolled, there are some cases where hot cracks may be produced in the edge portion(s) or surface of the ingot. However, if the copper base alloy contains 20 to 100 ppm of C, it is possible to effectively inhibit hot cracks from being produced. It is considered that the reasons for this areas follows. Since the degree of solid solution of C in Cu is small, a simple substance of C deposits during casting, or a compound of an additional element or impurity C is produced, to function as a nucleation cite to decrease the crystal grain size of the ingot, or the excessive segregation of Zn and/or Sn to the grain boundary is inhibited to make components uniform to inhibit the deposition of a second phase having a low melting point which has a bad influence on the hot workability, so that C segregated in the grain boundary during heating promotes recrystallization during hot rolling.

In addition, C caused to be contained in the copper base alloy functions as a deoxidizer to have the function of removing oxygen in a molten metal. The C in the molten metal reacts with O to form a gas component, such as CO or $CO_2$, to leave the molten metal to have the function of deoxidizing the molten metal. If the amount of C is less than 20 ppm, these advantageous effects can not be obtained. On other hand, if the amount of C exceeds 1000 ppm, a large amount of C or carbide of the additional element is produced on grain boundaries or in grains to deteriorate the hot workability. Therefore, the amount of C is preferably in the range of from 20 ppm to 1000 ppm, and more preferably, in the range of from 25 ppm to 500 ppm.

If C is thus caused to be contained in the molten metal of the copper base alloy to provide the copper base alloy containing C, it is possible to inhibit hot cracks from being produced. By this function, even if the abrasion of a casing die or unbalanced cooling makes casting conditions unstable to easily produce hot cracks, it is possible to inhibit hot cracks from being produced so that it is possible to improve yields.

By causing the copper base alloy to contain C as described above, it is possible to improve the hot workability of the copper base alloy. Such an advantageous effect can be more remarkably obtained in a copper base alloy wherein the temperature difference between liquidus and solidus lines (molten temperature range) is 30° C. or more, i.e. a copper base alloy wherein segregation in solidification is easy to occur during casting to easily produce hot cracks. In a material having a wide molten temperature range, segregation in solidification is easy to proceed during casting, and phases having a low melting point are easy to remain during solidification. Therefore, the above described advantageous effect can be more remarkably obtained in a copper base alloy wherein the temperature difference between liquidus and solidus lines is 30° C. or more, and can be more effectively obtained in a copper base alloy wherein the temperature difference between liquidus and solidus lines is 50° C. or more.

Moreover, by causing the copper base alloy to contain a very small amount of C, it is possible to improve the stress corrosion cracking resistance and stress relaxation resistance of the copper base alloy. It is considered that the reason for this is that C caused to be contained in the copper base alloy is segregated in the grain boundary to inhibit coarsening and corrosion of the grain boundary in a production process, such as hot rolling and annealing, after melting and casting.

If Zn is added to the copper base alloy, the strength and spring characteristic of the copper base alloy are improved, and migration resistance thereof is improved. Since Zn is cheaper than Cu, it is possible to reduce material costs by increasing the amount of Zn to be added. However, since the stress corrosion cracking resistance and corrosion resistance of the copper base alloy deteriorate with the increase of Zn to be added, it is required to choose the Zn content of the copper base alloy in accordance with the use of the copper base alloy. Therefore, the Zn content can be chosen in the range of from 8.0 to 45 wt % in accordance with the use of the copper base alloy. If the copper base alloy is used as the material of a spring, the Zn content is preferably in the range of from 20 to 45 wt %. Because the reinforcement of solid solution due to Zn is insufficient if the Zn content is 20 wt % or less and because the beta phase excessively deposits to extremely deteriorate the cold workability of the copper alloy if the Zn content exceeds 45 wt %.

If Sn is added to the copper base alloy, mechanical characteristics, such as 0.2% proof stress, tensile strength and spring limit value, of the copper base alloy are improved. The copper base alloy preferably contains Sn from the point of view of recycling of the material, the surface of which is treated with Sn. However, if the Sn content of the copper base alloy increases, the conductivity of the copper base alloy does not only deteriorates, but hot cracks are also easily produced in the copper base alloy. In addition, if the Sn content of the copper base alloy increases, material costs are increased. Therefore, the Sn content of the copper base alloy may be selected in the range of from 0.2 to 12.0 wt %. If the copper base alloy is used as the material of a spring, the Sn content thereof is preferably in the range of from 0.3 to 8.0 wt %. If the Sn content is less than 0.2 wt %, the improvement of the strength of the copper base alloy due to the reinforcement of solid solution of Sn is insufficient, and if the Sn content exceeds 12.0 wt %, delta and epsilon phases excessively deposit to deteriorate the cold workability of the copper base alloy.

If the copper base alloy contains one or more elements which are selected from 0.01 to 10.0 wt % of manganese (Mn), 0.01 to 10.0 wt % of aluminum (Al), 0.01 to 3.0 wt % of silicon (Si), 0.01 to 15.0 wt % of nickel (Ni), 0.01 to 5.0 wt % of iron (Fe), 0.01 to 5.0 wt % of chromium (Cr), 0.01 to 2.5 wt % of cobalt (Co), 0.01 to 3.0 wt % of titanium (Ti), 0.001 to 4.0 wt % of bismuth (Bi), 0.05 to 4.0 wt % of lead (Pb), 0.01 to 2.0 wt % of magnesium (Mg), 0.01 to 0.5 wt % of phosphorus (P), 0.0005 to 0.5 wt % of boron (B), 0.01 to 0.1 wt % of calcium (Ca), 0.01 to 0.1 wt % of yttrium (Y), 0.01 to 0.1 wt % of strontium (Sr), 0.01 to 1.0 wt % of beryllium (Be), 0.01 to 0.5 wt % of zirconium (Zr), 0.1 to 3.0 wt % of niobium (Nb), 0.1 to 3.0 wt % of vanadium (V), 0.1 to 3.0 wt % of hafnium (Hf), 0.1 to 3.0 wt % of molybdenum (Mo) and 0.1 to 3.0 wt % of tantalum (Ta), it is possible to improve the mechanical characteristics, such as 0.2% proof stress, strength and spring limit value, of the copper base alloy. It is also possible to improve the stress corrosion cracking resistance and stress relaxation resistance of the copper base alloy by using additional elements, such as Si, Ni and Mn. In addition, it is possible to improve the heat resistance, stress relaxation resistance and proof stress of the copper base alloy by adding Cr thereto, and it is possible to inhibit the production of hot cracks due to the scale down of cast structure by adding Mg, Fe, Cr, Si, Ca or P thereto. Moreover, it is possible to improve the free-cutting workability of the copper base alloy by adding Pb or Bi thereto.

If the amount of the above described additional elements is lower than the lower limit in the above described range, the advantageous effects can not be expected, and if it exceeds the above described range, the hot workability of the copper base alloy does not only deteriorate, but costs are also increased.

The relationship between the contents of Sn, Zn and other additional elements will be described below. If Sn is added to a Cu—Zn alloy, it is possible to improve the stress relaxation resistance and stress corrosion cracking resistance of the Cu—Zn alloy. However, the difference between liquidus and solidus lines increases in the presence of both of Zn and Sn, and cracks are easily produced during hot working even in the presence of C. In order to obtain a good hot workability, the relationship expressed by the following formula (1) is preferably established between the Zn content X (wt %) and Sn content Y (wt %) of the alloy.

$$x+5Y \leqq 50 \quad (1)$$

If additional elements, such as Mn, Al, Si, Ni, Fe, Cr, Co, Ti, Bi, Pb, Mg, P, B, Ca, Y, Sr, Be, Zr, Nb, V, Hf, Mo and Ta, are added to the alloy, the hot workability thereof varies. In such a case, all of the following formulae (2), (3) and (4) are preferably satisfied between the Zn content X (wt %), the Sn content Y (wt %) and the total amount Z (wt %) of other additional elements of the alloy.

$$X+5Y+4Z \leqq 50 \quad (2)$$

$$X+4Z \leqq 50 \quad (3)$$

$$5Y+4Z \leqq 45 \quad (4)$$

If the amount of the additional elements exceeds the above described range, the melting/solidifying range is widen during casting, so that cracks are easily produced during hot working even if the alloy is caused to contain C.

The relationship between phases will be described below. Second phases other than alpha phase are produced in accordance with the combination of the above described additional elements. The second phases include Cu—Zn beta (β), gamma (γ) and epsilon (ϵ) phases, and Cu—Sn beta (β), epsilon (ϵ), eta (η) and delta (δ) phases. There are also Ni—Si compounds obtained by adding both of Ni and Si, Ni—P compounds and Fe—P compounds obtained by adding both of Ni and Fe or P, and $Fe_3C$ and Sic obtained by adding both of C and Fe or Si. The simple substance of Cr, Ti, Bi or Pb forms a deposit. Such deposits formed by adding additional elements, e.g., deposits having a high melting point formed by adding Cr or Ti, Ni—Si compounds and Ni—P compounds, have the function of improving the stress relaxation resistance of a copper base alloy. Deposits formed by adding Bi or Pb have the function of improving the free-cutting workability of a copper base alloy. However, if the melting point of the second phases and the melting point of third phases in some cases are 800° C. or less, and if the volume percentage thereof is 20% or more, there are some cases where the second and third phases may melt to produce hot cracks during heating. Therefore, the volume percentage of phases having a low melting point of 800° C. or less other than alpha phase is preferably 20% or less.

Impurities will be described below. The amount of S and O of impurities is preferably as small as possible. Even if the copper base alloy contains a small amount of S, the deformability of the material in hot rolling remarkably deteriorates. In particular, if an electrolytic copper is used as the material of a cast copper base alloy as it is, there are some cases where the alloy may contain S. However, if the amount of S is controlled, it is possible to prevent cracks from being produced in hot rolling. In order to realize such advantageous effects, the amount of S must be 30 ppm or less, and is preferably in the range of from 15 ppm or less. In addition, if the alloy contains a large amount of O, the alloy components, such as Sn, and elements, such as Mg, P, Al and B, which are added as deoxidizers, form oxides. Such oxides do not only deteriorate the hot workability of the alloy, but they may also deteriorate characteristics, such as plating adhesion, of the copper base alloy. Therefore, the O content of the alloy is preferably 50 ppm or less.

A preferred embodiment of a method for producing a copper base alloy according to the present invention will be described below.

First, a melting/casting step will be described. In a preferred embodiment of a method for producing a copper base alloy according to the present invention, the hot workability of the alloy is improved by causing the alloy to contain an appropriate amount of C. Since the degree of solid solution of C in Cu is small and since the specific gravity of C is smaller than that of Cu, it is difficult to obtain a copper base alloy containing a predetermined amount of C even if C is dissolved or dispersed in a molten copper base alloy as it is. In order to solve this problem, the inventors have diligently studied and found that it is possible to cause a copper base alloy to contain C by the following methods.

As raw materials to be melted, materials, such as mills ends and punched scraps, which are produced during the production of materials and which have a large surface area, may be used. Such mills ends and punched scraps contain oil contents, such as slit oils and punching oils, and carbon (C), such as soot and fibers, absorbed onto the surface. Therefore, it is possible to introduce C into the molten metal during melting. The mills ends include slit scraps and undesired portions of coils at the front and rear ends thereof. If mills ends, which are casting materials for Cu and Zn, and C in punched scraps are thus utilized, C having a small degree of solid solution in Cu can be dispersed in the molten metal. In addition, since scraps can be utilized as casting materials, costs can be decreased.

As a raw material to be used, a larger amount of a copper base alloy having a liquidus line temperature of 1050° C. or less is preferably used. For example, such a copper base alloy corresponds to a copper base alloy containing 20 wt % or more of Zn in the case of a copper base alloy containing a large amount of Zn, and corresponds to a copper base alloy containing 6 wt % or more of Sn in the case of a copper base alloy containing Sn. It is considered that the reasons for this are that the melting time decreases if the melting point decreases, that it is possible to decrease the amount of C lost during the melting operation if the melting point decreases and that component elements can form oxide films on the surface of the molten metal during melting to prevent C from being lost. If the copper base alloy contains Zn and Sn and if the material having a melting point of 1000° C. or less is used as the raw material, it is possible to obtain more advantageous effects. The amount of such a raw material having a low melting point is preferably 20% or more with respect to the weight of the molten metal. Because such advantageous effects can not be sufficiently obtained if it is 20% or less.

If mills ends and punched scraps of materials which are surface-treated with Sn, such as materials plated with Sn, are used, it is possible to more effectively cause C to remain. It is considered that the reasons for this are that the amount of oil contents remaining on the surface increases by using materials surface-treated with Sn, that it is possible to utilize C contained in an Sn plating and an underlying Cu plating, and that Sn is first melted at the melting step to enhance the stability of C absorbed onto the surface. Moreover, it is possible to reduce raw material costs for Sn and the cost of peeling the Sn plating.

In order to cause the copper base alloy to contain C or in order to increase the C content in the copper base alloy, it is possible to effectively use an alloy producing a compound of C with C, such as Fe—C, and a mother alloy of a metal in which C is solid-dissolved in a high degree. However, the amount of C must be within the above described component range. It is also important to sufficiently agitate the molten metal to cause C to disperse therein.

Moreover, even if the molten metal is caused to contain C as described above, C may be lost in the dioxidation process since C has a deoxidizing function. As methods for preventing the loss of C which is solid-dissolved or dispersed in the molten metal, there are the following methods.

First, there is a method for coating the surface of a crucible or distributor during melting/casting, with a solid material containing 70 wt % or more of C, such as charcoal or C powder. If this method is used, it is possible to decrease the oxidation loss of C. In addition, it is possible to expect an advantage in that the molten metal is caused to contain C by the reaction of the molten metal with the solid material which contains 70 wt % or more of C and which is utilized for coating the surface. Moreover, there is an advantage in that it is possible to inhibit the production of oxides of additional elements, such as Sn, due to oxidation of the molten metal. Similarly, there can be effectively used a method for using a crucible for melting, a crucible for holding before casting after melting, and a crucible containing 70 wt % or more of C as a die.

There is also a method for utilizing a solid deoxidizer having a stronger affinity with O than C. Specifically, there is a method for adding at least one of B, Ca, Y, P, Al, Si, Mg, Sr, Mn, Be and Zr to the molten metal. These solid deoxidizers can more preferentially react with O in the molten metal than the reaction of C with O to inhibit the decrease of the amount of C in the molten metal. These solid deoxidizers and component elements can produce compounds to cause the grain refining effect in the ingot during casting.

Specifically, the produced compounds include oxides, carbides and sulfides, such as B—O, B—C, Ca—S, Ca—O, Mg—O, Si—C, Si—O and Al—O compounds. These compounds are finely dispersed in the molten metal to act as a nucleation cite during solidification to cause the scale down of the cast structure and the uniform grain boundary.

The amount of the deoxidizing element to be added to the molten metal is preferably 0.005% or more and 0.5% or less with respect to the weight of the molten metal. Because it is not possible to sufficiently obtain advantageous effects if it is less than 0.005% and it is not economical if it exceeds 0.5%. This amount to be added is the weight of the element to be added, not the amount of the component remaining in the alloy. Naturally, the amount of the component contained in the alloy is smaller than the amount of the element to be added, by the loss due to oxidation and so forth.

Although the above described methods for causing the molten metal to contain C and for preventing oxidation of the molten metal may be separately used, there are more advantageous effects if these method are combined.

Examples of copper base alloys and methods for producing the same according to the present invention will be described below in detail.

EXAMPLES 1-8 AND COMPARATIVE EXAMPLES 1-4

Raw materials of each copper base alloy having chemical components shown in Table 1 were put in a crucible of silica ($SiO_2$) as a main component to be heated to 1100° C. to be held for 30 minutes while the surface of a molten metal thus obtained was covered with C powder. Thereafter, an ingot having a size of 30 mm×70 mm×1000 mm was cast by means of a vertical small continuous casting machine. As the raw materials of each copper base alloy, Sn plated scraps of JISC 2600 (Cu-30Zn) were used at weight percentages shown in Table 1, and oxygen free copper (JISC 1020), Zn bullion and Sn bullion were used as other raw materials for adjusting the components. In addition, B, Mg and Si used as deoxidizers were added by melting Cu—B, Cu—Mg and Cu—Si mother alloys with the raw materials. Moreover, Cr and Ni were added by utilizing Cu—Cr mother alloy and Ni bullion. Furthermore, in Comparative Example 4, scraps of commercially available oxygen free copper were used, and the balance was adjusted so as to contain predetermined amounts of Zn and Sn.

Thereafter, each ingot was heated at a temperature of 820 to 850° C. in an atmosphere of a mixture of hydrogen and nitrogen in the ratio of one to one. Then, hot rolling was carried out so that the ingot has a thickness of 5 mm. The hot workability of each of the hot-rolled test pieces was evaluated on the basis of the presence of cracks on the surface and edges thereof. In this evaluation, the hot workability was evaluated as "good" when no cracks were observed, and as "bad" when cracks were observed, by a 24-power stereoscopic microscope after pickling the surface. The results of evaluation of the hot workability are shown in Table 2.

With respect to the analysis of chemical components shown in Table 1, for analyzing samples cut out from the central portion of each of the hot-rolled test pieces in lateral directions, the analysis of C and S was carried out by means of a carbon/sulfur trace analyzer (EMIA-U510 produced by Horiba Co., Ltd.), and the analysis of other elements was carried out by means of an ICP-mass spectrometer (AGILENT 7500i produced by HP company). In Table 1, "–" was given when the amount of C and S was 10 ppm or less, and "–" was given when elements shown by "others" are not added.

TABLE 1

| | Zn (wt %) | Sn (wt %) | C (ppm) | S (ppm) | others | Weight Percentage of Plating Scrap |
|---|---|---|---|---|---|---|
| Ex. 1 | 25.2 | 0.91 | 90 | — | — | 20 |
| Ex. 2 | 25.3 | 0.72 | 440 | — | — | 50 |
| Ex. 3 | 24.8 | 0.73 | 200 | — | B: 10 ppm | 20 |
| Ex. 4 | 25.1 | 1.12 | 250 | — | B: 10 ppm | 50 |
| Ex. 5 | 25.1 | 0.79 | 160 | 20 | Mg: 0.1 wt % | 50 |
| Ex. 6 | 25.0 | 0.61 | 80 | — | Si: 0.2 wt % | 50 |
| Ex. 7 | 23.8 | 0.88 | 200 | 15 | Ni: 0.3 wt % | 40 |
| Ex. 8 | 21.3 | 1.52 | 90 | — | — | 30 |
| Comp. 1 | 23.8 | 0.85 | — | — | — | 0 |
| Comp. 2 | 24.9 | 0.72 | 15 | — | — | 10 |
| Comp. 3 | 24.1 | 0.81 | 15 | — | Cr: 0.1 wt % | 0 |
| Comp. 4 | 24.9 | 0.76 | — | 15 | — | 0 |

TABLE 2

| | Hot Rolling Test Results |
|---|---|
| Example 1 | good |
| Example 2 | good |
| Example 3 | good |
| Example 4 | good |
| Example 5 | good |
| Example 6 | good |
| Example 7 | good |
| Example 8 | good |
| Comparative Example 1 | bad |
| Comparative Example 2 | bad |
| Comparative Example 3 | bad |
| Comparative Example 4 | bad |

As shown in Table 2, no cracks were observed when the copper base alloys in Examples 1-8 were hot-rolled, so that it was found that the copper base alloys in Examples 1-8 have an excellent hot workability. In Comparative Examples 1-4 wherein the amount of C was small, a plurality of cracks extending in directions perpendicular to the rolling direction were produced by hot rolling. The portions having cracks were observed by an optical microscope after being etched. As a result, it was verified that the cracks was intercrystalline cracks since the cracks extended along the grain boundary.

Comparing Examples 1-8 with Comparative Examples 1-4, it can be seen that it is possible to cause the copper base alloy to contain C by melting and casting in a method for producing a copper base alloy according to the present invention.

EXAMPLES 9, 10 AND COMPARATIVE EXAMPLE 5

In order to verify the influence of C on the hot workability on larger scale conditions, 15000 kg of each copper base alloy of chemical components shown in Table 3 was melted in a crucible mainly formed of silica. From each copper base alloy, four ingots having a size of 180 mm×500 mm×3600 mm were obtained by means of a vertical continuous casting machine. In this casting, there was used a copper mold which sufficiently wore off by casting a Cu—Zn alloy, such as JIS C2600 or JIS C2801, 5000 times or more while repeatedly polishing the surface of the mold.

TABLE 3

| | Zn (wt %) | Sn (wt %) | C (ppm) | S (ppm) | O (ppm) |
|---|---|---|---|---|---|
| Ex. 9 | 25.1 | 0.82 | 230 | — | 30 |
| Ex. 10 | 24.8 | 0.73 | 90 | — | 20 |
| Comp. 5 | 24.9 | 0.76 | — | 10 | 20 |

With respect to the copper base alloys in Examples 9 and 10, Sn plated scraps of JIS C2600 having oils on the surface thereof were used as main raw materials. When the copper base alloys in Examples 9 and 10 were cast, the surface of the crucible and the surface of the turn dish were covered with charcoal and carbon powder with respect to the surface of the molten metal during melting and casting. On other hand, in the copper base alloy in Comparative Example 5, scraps of JIS C1020 and C1100 having a C content of 10 ppm or less were used as the raw materials of Cu, and were cast while the molten metal was covered with carbon powder during melting and casting. Therefore, in the copper base alloy in Comparative Example 5, only the surface of the molten metal contacted C.

Thereafter, the ingot was held at 870° C. for two hours, and then, the ingot was hot-rolled to obtain a hot rolled material having a thickness of 10.3 mm. The surface of the hot rolled material was observed in this process. As a result, the surface of the hot rolled material was evaluated as "good" when no cracks were observed in all of four coils, and as "bad" when cracks were observed. The results of evaluation of the hot workability are shown in Table 4.

Components were controlled and analyzed in the same manner as that in Example 1. Oxygen was analyzed by means of an oxygen/nitrogen simultaneous analyzer (TC-436 produced by LECO Company).

TABLE 4

| | Hot Rolling Test Results |
|---|---|
| Example 9 | good |
| Example 10 | good |
| Comparative Example 5 | bad |

With respect to each of Examples 9, 10 and Comparative Example 5, a good ingot having no surface defects was obtained during casting. When the surface of the ingot was observed, there was no different between Examples 9, 10 and Comparative Example 5.

As shown in Table 4, it was verified that the copper base alloys in Examples 9 and 10 containing 230 ppm and 90 ppm of C, respectively, have no cracks during casting and hot rolling, and have an excellent hot workability. In Comparative Example 5 wherein the hot rolling was carried out on the same conditions, a plurality of cracks were observed during hot rolling.

Thus, the copper base alloys in Examples 9 and 10 have an excellent hot workability to be capable of inhibiting the occurrence of cracks during hot rolling, so that it is possible to obtain products in good yield.

It can be seen that the method in Examples 9 and 10 can cast the copper base alloy while C exists in the ingot. After C in the front and rear ends of the ingot was analyzed, there was a small difference therebetween.

EXAMPLE 11, COMPARATIVE EXAMPLES 6 AND 7

In Example 11, in order to verify characteristics of materials of rods/bars produced as described above, the same base alloy as that in Example 10 was repeatedly cold-rolled and annealed to obtain a cold rolled material having a thickness of 1 mm and a grain size of about 10 μm. Then, the cold rolled material thus obtained was rolled so as to have a thickness of 0.25 mm, and low-temperature annealed at a temperature of 230° C. at the final step. From a rod/bar thus obtained, a test piece was obtained.

With respect to the rod/bar thus obtained, 0.2% proof stress, tensile strength, Young's modulus, conductivity, stress relaxation rate and stress corrosion cracking life were measured. The 0.2% proof stress, tensile strength and Young's modulus were measured in accordance with JIS-Z-2241, and the conductivity was measured in accordance with JIS-H-0505. The stress relaxation test was carried out in directions parallel to the rolling direction, by applying a bending stress, which was 80% of 0.2% proof stress, to the surface of the sample, holding the sample at 150° C. for 500 hours, and measuring a bending habit. The stress relaxation rate was calculated by the following formula:

$$\text{Stress Relaxation Rate (\%)}=[(L_1-L_2)/(L_1-L_O)]\times 100$$

wherein $L_0$ is the length (mm) of a tool, $L_1$ being the length (mm) of a sample at the beginning, $L_2$ being the horizontal distance (mm) between ends of the sample after treatment.

The stress corrosion cracking test was carried out in directions parallel to the rolling direction, by applying a bending stress, which was 80% of 0.2% proof stress, and holding the sample in a desiccator including 12.5% aqueous ammonia. Each exposure time was 10 minutes, and the test was carried out for 150 minutes. After exposure, the sample piece was taken out every exposure time. Then, the sample was pickled to remove a film therefrom if necessary, and cracks in the sample were observed by means of an optical microscope at a magnifying power of 100. The stress corrosion cracking life was set to be ten minutes before the verification of cracks.

As comparative examples, a copper base alloy (Comparative Example 6) obtained by cold-rolling and annealing a copper base alloy containing the same components as those in Comparative Example 5, in the same manner as that in Example 11, and an SH (H08) material (Comparative Example 7) having the highest strength among commercially available brasses (C2600), were used for carrying out the same test as that in Example 11. The results of these tests are shown in Table 5.

TABLE 5

| | | Ex. 11 | Comp. 6 | Comp. 7 |
|---|---|---|---|---|
| Modulus of Longitudinal Elasticity | L.D. | 109 | 109 | 112 |
| | T.D. | 116 | 118 | 119 |
| Tensile Strength ($N/mm^2$) | L.D. | 821 | 818 | 672 |
| | T.D. | 931 | 930 | 791 |
| 0.2% Proof Stress | L.D. | 856 | 850 | 641 |
| | T.D. | 819 | 820 | 715 |
| Conductivity (% LACS) | | 24.8 | 25.4 | 27.2 |
| Stress Relaxation Rate (%) | | 15.4 | 18.2 | 49.2 |

TABLE 5-continued

| | Ex. 11 | Comp. 6 | Comp. 7 |
|---|---|---|---|
| Stress Corrosion Cracking Life (min) | 120 | 100 | 20 |

note:
L.D.: Direction Parallel to Rolling Direction
T.D.: Direction Perpendicular to Rolling Direction From the results shown in Table 5, it can be seen that the copper base alloy in Example 11 has more excellent stress corrosion cracking resistance and stress relaxation resistance than those of Cu—Zn—Sn alloys since it contains C. In can be also seen that the copper base alloy in Example 11 has excellent mechanical characteristics and conductivity, and is most suitable for the material of connectors.

As described above, a copper base alloy according to the present invention has an excellent hot workability, and a method for producing a copper base alloy according to the present invention can easily obtain a copper base alloy in good yield by causing the copper base alloy to contain a very small amount of C. Moreover, if a copper base alloy according to the present invention is used as the material of electric/electronic parts, such as terminals and connectors, and springs, it is possible to inexpensively produce parts having excellent spring characteristics.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A copper base alloy consisting of 8 to 45 wt % of zinc, 0.2 to 12.0 wt % of tin, 80 to 1000 ppm of carbon, and the balance being copper and unavoidable impurities, wherein a difference in temperature between liquidus and solidus lines is 30° C. or more.

2. A copper base alloy as set forth in claim 1, wherein $X+5Y \leqq 50$, assuming that the content of zinc is X (wt %) and the content of tin is Y (wt %).

3. A copper base alloy consisting of 8 to 45 wt % of zinc, 0.2 to 12.0 wt % of tin, 80 to 1000 ppm of carbon, and the balance being copper and unavoidable impurities, wherein a phase of the copper base alloy other than an alpha phase has a volume percentage of 20% or less.

4. A copper base alloy as set forth in claim 3, wherein said phase of the copper base alloy other than the alpha phase has a melting point of 800° C. or less.

5. A copper base alloy as set forth in claim 3, wherein $X+5Y \leqq 50$, assuming that the content of zinc is X (wt %) and the content of tin is Y (wt %).

6. A copper base alloy consisting of 8 to 45 wt % of zinc, 0.2 to 12.0 wt % of tin, 80 to 1000 ppm of carbon, and the balance being copper and unavoidable impurities, wherein $X+5y \leqq 50$, assuming that the content of zinc is X (wt %) and the content of tin is Y (wt %).

* * * * *